US008292580B2

(12) United States Patent
Schiavo et al.

(10) Patent No.: US 8,292,580 B2
(45) Date of Patent: Oct. 23, 2012

(54) CMC VANE ASSEMBLY APPARATUS AND METHOD

(75) Inventors: Anthony L. Schiavo, Oviedo, FL (US); Malberto F. Gonzalez, Orlando, FL (US); Kuangwei Huang, Singapore (SG); David C. Radonovich, Cranberry Township, PA (US)

(73) Assignee: Siemens Energy, Inc., Orlando, FL (US)

( * ) Notice: Subject to any disclaimer, the term of this patent is extended or adjusted under 35 U.S.C. 154(b) by 634 days.

(21) Appl. No.: 12/479,047

(22) Filed: Jun. 5, 2009

(65) Prior Publication Data

US 2010/0068034 A1 Mar. 18, 2010

Related U.S. Application Data

(60) Provisional application No. 61/097,927, filed on Sep. 18, 2008, provisional application No. 61/097,928, filed on Sep. 18, 2008.

(51) Int. Cl.
*F01D 5/08* (2006.01)
*F01D 5/18* (2006.01)

(52) U.S. Cl. ..... 416/96 A; 416/97 A; 416/229 A

(58) Field of Classification Search ..... 416/96 A, 416/97 A, 226, 229 A
See application file for complete search history.

(56) References Cited

U.S. PATENT DOCUMENTS 2,914,300 A * 11/1959 Sayre ..... 415/135
3,992,127 A * 11/1976 Booher et al. ..... 415/136
6,000,906 A * 12/1999 Draskovich ..... 415/209.4
6,200,092 B1 3/2001 Koschier
6,464,456 B2 10/2002 Darolia et al.
6,514,046 B1 * 2/2003 Morrison et al. ..... 416/229 A
6,648,597 B1 11/2003 Widrig et al.
6,984,101 B2 1/2006 Schiavo, Jr.
7,093,359 B2 8/2006 Morrison et al.
7,114,917 B2 10/2006 Legg
7,201,564 B2 4/2007 Bolms et al.
7,255,534 B2 8/2007 Liang
7,281,895 B2 10/2007 Liang
7,316,539 B2 1/2008 Campbell
2006/0222487 A1 10/2006 Au
2006/0228211 A1 10/2006 Vance et al.
2007/0237630 A1 10/2007 Schiavo, Jr. et al.
2011/0110772 A1 * 5/2011 Arrell et al. ..... 415/177

* cited by examiner

*Primary Examiner* — Edward Look
*Assistant Examiner* — Jason Davis

(57) ABSTRACT

A metal vane core or strut (64) is formed integrally with an outer backing plate (40). An inner backing plate (38) is formed separately. A spring (74) with holes (75) is installed in a peripheral spring chamber (76) on the strut. Inner and outer CMC shroud covers (46, 48) are formed, cured, then attached to facing surfaces of the inner and outer backing plates (38, 40). A CMC vane airfoil (22) is formed, cured, and slid over the strut (64). The spring (74) urges continuous contact between the strut (64) and airfoil (66), eliminating vibrations while allowing differential expansion. The inner end (88) of the strut is fastened to the inner backing plate (38). A cooling channel (68) in the strut is connected by holes (69) along the leading edge of the strut to peripheral cooling paths (70, 71) around the strut. Coolant flows through and around the strut, including through the spring holes.

15 Claims, 5 Drawing Sheets

CMC VANE ASSEMBLY APPARATUS AND METHOD

CROSS-REFERENCE TO RELATED APPLICATIONS

Applicants claim the benefit of U.S. provisional patent applications 61/097,927 and 61/097,928, both filed on Sep. 18, 2008, and incorporated by reference herein.

STATEMENT REGARDING FEDERALLY SPONSORED DEVELOPMENT

Development for this invention was supported in part by Contract No. DE-FC26-05NT42646, awarded by the United States Department of Energy. Accordingly, the United States Government may have certain rights in this invention.

FIELD OF THE INVENTION

This invention relates to a combustion turbine vane assembly with a metal vane core and a ceramic matrix composite (CMC) or superalloy airfoil sheath on the core, the core and airfoil spanning between metal backing plates, the plates forming segments of inner and outer shrouds surrounding an annular working gas flow path. The invention also relates to ceramic matrix composite or superalloy shroud covers.

BACKGROUND OF THE INVENTION

Combustion turbines include a compressor assembly, a combustor assembly, and a turbine assembly. The compressor compresses ambient air, which is channeled into the combustor where it is mixed with fuel and burned, creating a heated working gas. The working gas can reach temperatures of about 2500-2900° F. (1371-1593° C.), and is expanded through the turbine assembly. The turbine assembly has a series of circular arrays of rotating blades attached to a central rotating shaft. A circular array of stationary vanes is mounted in the turbine casing just upstream of each array of rotating blades. The stationary vanes are airfoils that redirect the gas flow for optimum aerodynamic effect on the next array of rotating blades. Expansion of the working gas through the rows of rotating blades and stationary vanes causes a transfer of energy from the working gas to the rotating assembly, causing rotation of the shaft, which drives the compressor.

The vane assemblies may include an outer platform element or shroud segment connected to one end of the vane and attached to the turbine casing, and an inner platform element connected to an opposite end of the vane. The outer platform elements are positioned adjacent to each other to define an outer shroud ring, and the inner platform elements may be located adjacent to each other to define an inner shroud ring. The outer and inner shroud rings define an annular working gas flow channel between them.

Vane assemblies may have passageways for a cooling fluid such as air or steam. The coolant may be routed from an outer plenum, through the vane, and into an inner plenum attached to the inner platform elements. The vanes are subject to mechanical loads from aerodynamic forces on them while acting as cantilever supports for the inner platform elements and inner plenum. Thus, problems arise in assembling vanes with both the required mechanical strength and thermal endurance.

Attempts have been made to form vane platforms and vane cores of metal with a CMC cover layer. However forming CMC airfoils by wet layering on a metal core is unsatisfactory, because curing of CMC requires temperatures that damage metal. Also CMC has a different coefficient of thermal expansion than metal, resulting in separation of the airfoil from the metal during turbine operation. CMC or superalloy airfoils may be formed separately and then assembled over the metal core, but this involves problems with assembly. If an inner and outer platform and vane core are cast integrally, there is no way to slide CMC cover elements over them. Thus, attempts have been made to form CMC airfoils split into halves, connecting the halves over the vane core. However, this results in a ceramic seam, which must be cured in a separate high-temperature step that can damage metal and may cause lines of weakness in the airfoil. If the platforms and vane are cast separately it is challenging to mechanically connect them securely enough to withstand the cantilevered aerodynamic forces and vibrational accelerations. It is also challenging to mount a CMC airfoil over a metal vane core securely in a way that accommodates differential thermal expansion without allowing vibration.

BRIEF DESCRIPTION OF THE DRAWINGS

The invention is explained in the following description in view of the drawings that show.

DETAILED DESCRIPTION OF THE INVENTION

The inventors devised a vane assembly that can be fabricated using conventional metal casting and CMC fabrication, can be assembled with sufficient mechanical strength and thermal endurance, and accommodates differential thermal expansion, thus solving the above problems of the prior art. It limits stresses on the CMC airfoil to wall thickness compressive stresses, which are best for CMC, and it also provides an easily replaceable CMC vane airfoil.

Figure 1:
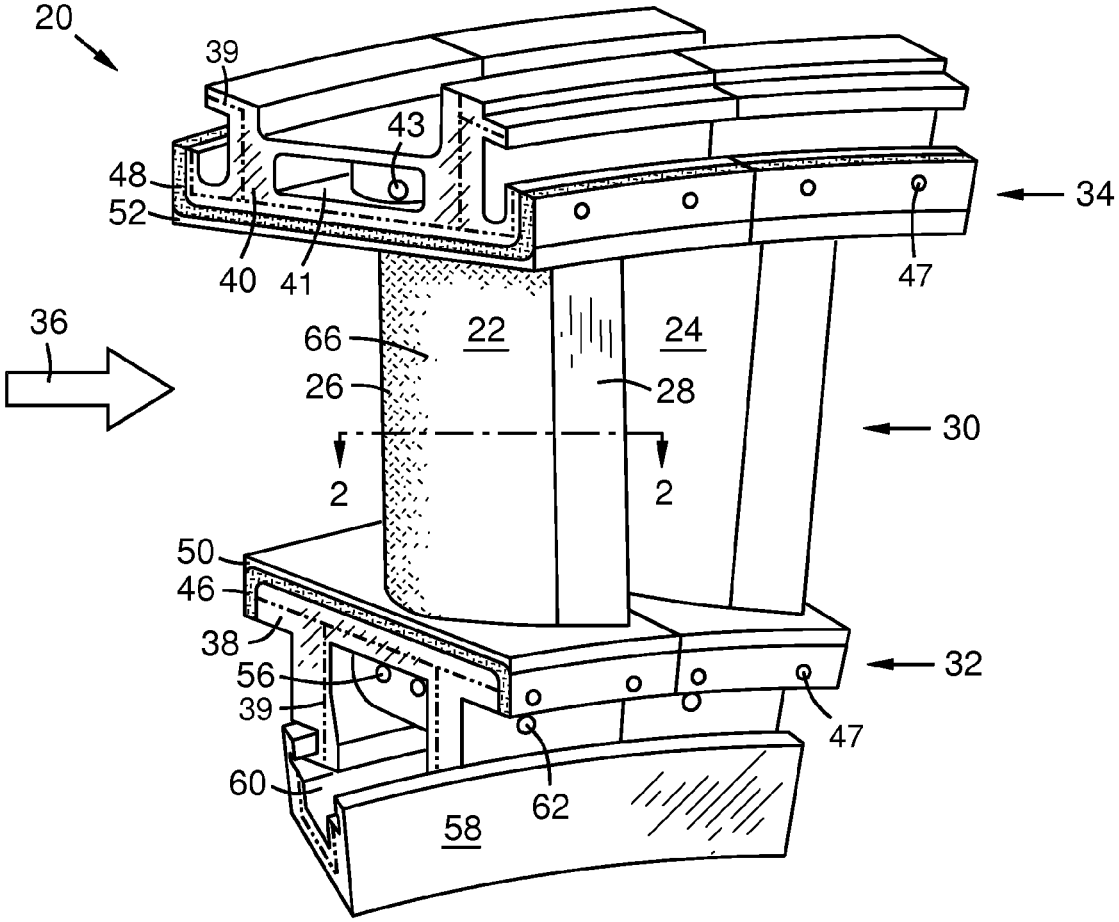
FIG. 1 is a perspective view of two adjacent vane assemblies according to aspects of the invention.

FIG. 1 shows an assembly of two stationary turbine vanes 22, 24 that are part of a circular array 30 of turbine vanes positioned between inner and outer shroud rings 32, 34. A hot working gas 36 passes through the annular path between the inner and outer shroud rings 32, 34, and over the vanes 30, which direct the gas flow 36 for optimal aerodynamic action against adjacent rotating turbine blades (not shown). Each shroud ring 32, 34 is formed of a series of arcuate platforms or backing plates 38, 40. Each turbine vane 22, 24 has a leading and trailing edge 26, 28, and spans radially between the inner and outer backing plates 38, 40. Herein, "radial" means generally perpendicular to the turbine shaft or turbine central axis (not shown). Each backing plate 38, 40 may be formed of a metal superalloy. The outer backing plate 40 may contain a plenum 41 with access to vane pin holes 43 for locking the vane airfoil 66 to the outer backing plate 40. Pins in holes 43, 47, and 62 are used to hold the assembly together during machining operations and engine installation/disassembly. The CMC airfoil cover and shroud covers are held in place during engine operation using a combination of pins and pressure loading, with the advantage of using leaks as discrete coolant purge. The inner backing plate 38 has coolant exhaust holes 56. A coolant such as air or steam flows from a coolant distribution plenum 80 (FIG. 4), through the vanes 22, and out of the cooling outlets 56. The inner backing plates 38 support a U-ring 58, which forms an inner cooling plenum 60 for return or exhaust of the coolant. A vane assembly pin hole 62 may be provided for locking the inner end of the vane 22 into the inner backing plate 38.

CMC shroud covers 46, 48 may be assembled over facing surfaces of the backing plates 38, 40, using pins in holes 47 or other fastening means, in order to thermally protect the backing plates from the working gas and to seal the working gas path. Ceramic thermal barrier coatings 50, 52 may be applied to the CMC shroud covers 46, 48. Intersegment gas seals 39 may be provided as known in the art.

Figure 2:
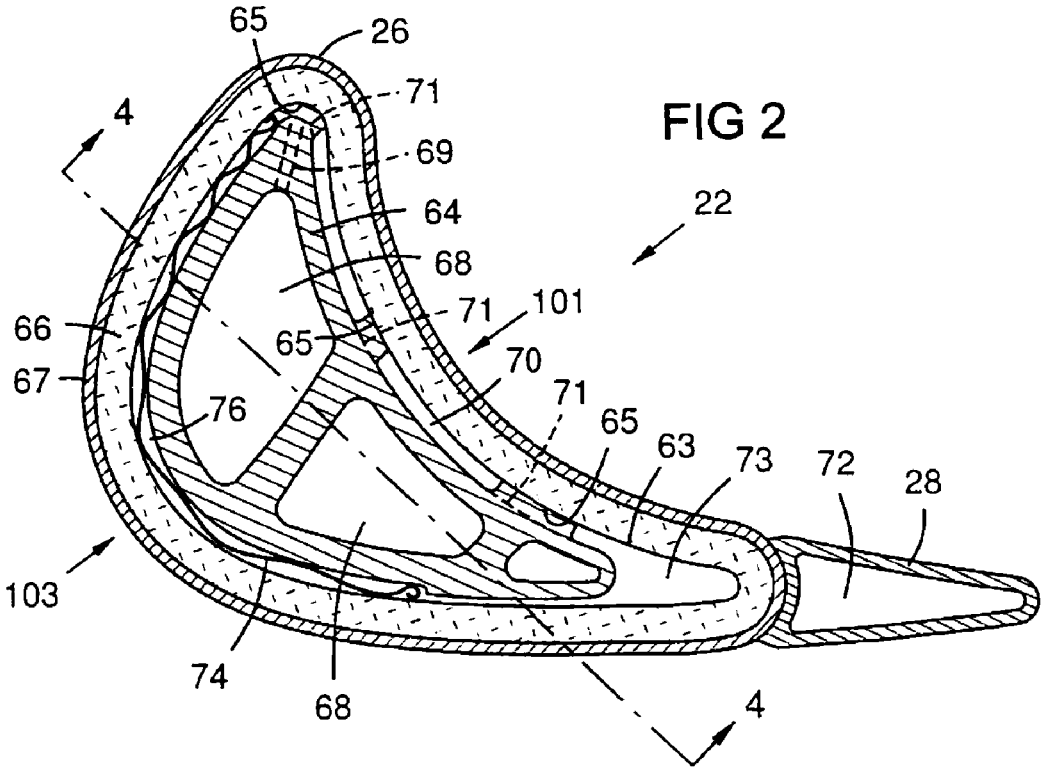
FIG. 2 is a sectional view of a vane taken along line 2-2 of FIG. 1.
Figure 3:
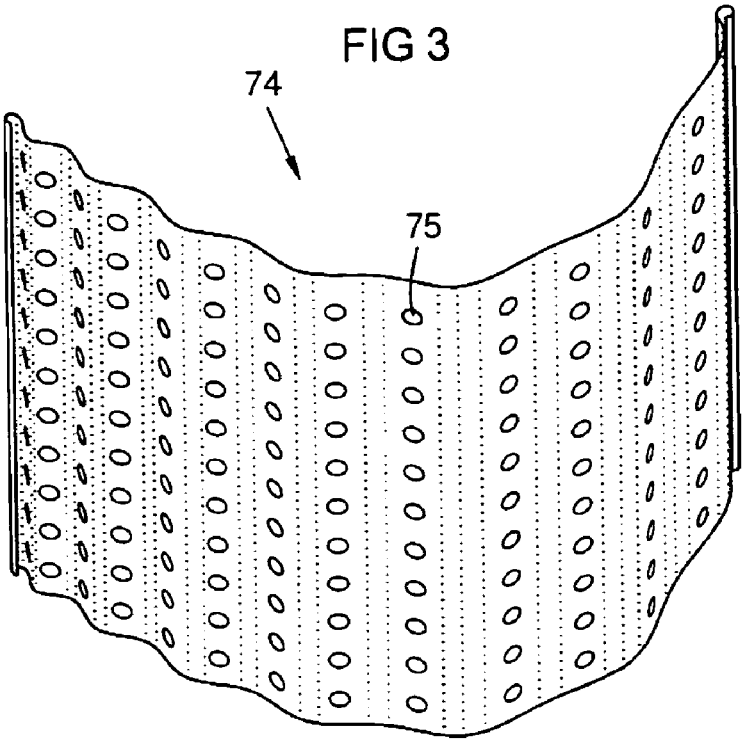
FIG. 3 is a perspective view of a wave spring with cooling holes.

FIG. 2 shows a cross section of a vane 22, with an inner core or strut 64 of metal, a vane airfoil 66 of CMC, and a trailing edge 28 of metal. The strut 64 and trailing edge 28 may be cast integrally with either the inner or outer backing plate 38, 40, preferably with the outer backing plate since that is the base of cantileverage. Peripheral contact areas 65 on the strut define a strut surface geometry that generally matches the inner surface 63 of the CMC airfoil. The CMC airfoil 66 slides over the strut 64 during assembly. The strut has one or more medial cooling channels 68 and a plurality of peripheral cooling paths in the radial direction 70 and in the transverse direction 71. The trailing edge may have one or more cooling channels 72 and/or any of several known cooling features used on high temperature components (such as pin fin arrays, turbulators/trip strips, pressure side ejection, etc). A spring 74 preloads the CMC vane airfoil 66 against the strut 64. The spring 74 may be a wave spring that is set in a peripheral spring chamber 76 extending most of the length of the strut 64. The spring chamber 76 may also serve as a peripheral cooling path in combination with holes 75 in the spring 74 as shown in FIG. 3. The CMC vane airfoil 66 may have a thermal barrier coating (TBC) 67 and/or a vapor resistant layer (VRL) as known in the art. Likewise, the metal trailing edge may have a TBC or VRL (not shown).

A medial cooling channel 68 is connected to the peripheral cooling paths 70, 71 by a row of leading edge tributaries 69. Coolant flows from the medial channel 68 through the leading edge tributaries 69 to the leading edge peripheral cooling paths 71, then around the vane strut in both transverse directions toward the trailing edge, through peripheral cooling paths 71 on the pressure side 101, and through the spring chamber 76 on the suction side 103. It then enters a trailing edge coolant drain 73, where it flows radially inward to the cooling plenum 60 in the inner U-ring 58. Coolant may also flow from one or more of the internal strut passages 68 into the cooling paths 70 or 76 through additional tributaries (not shown) through the pressure 101 and suction 103 sides of the strut 64.

Figure 4:
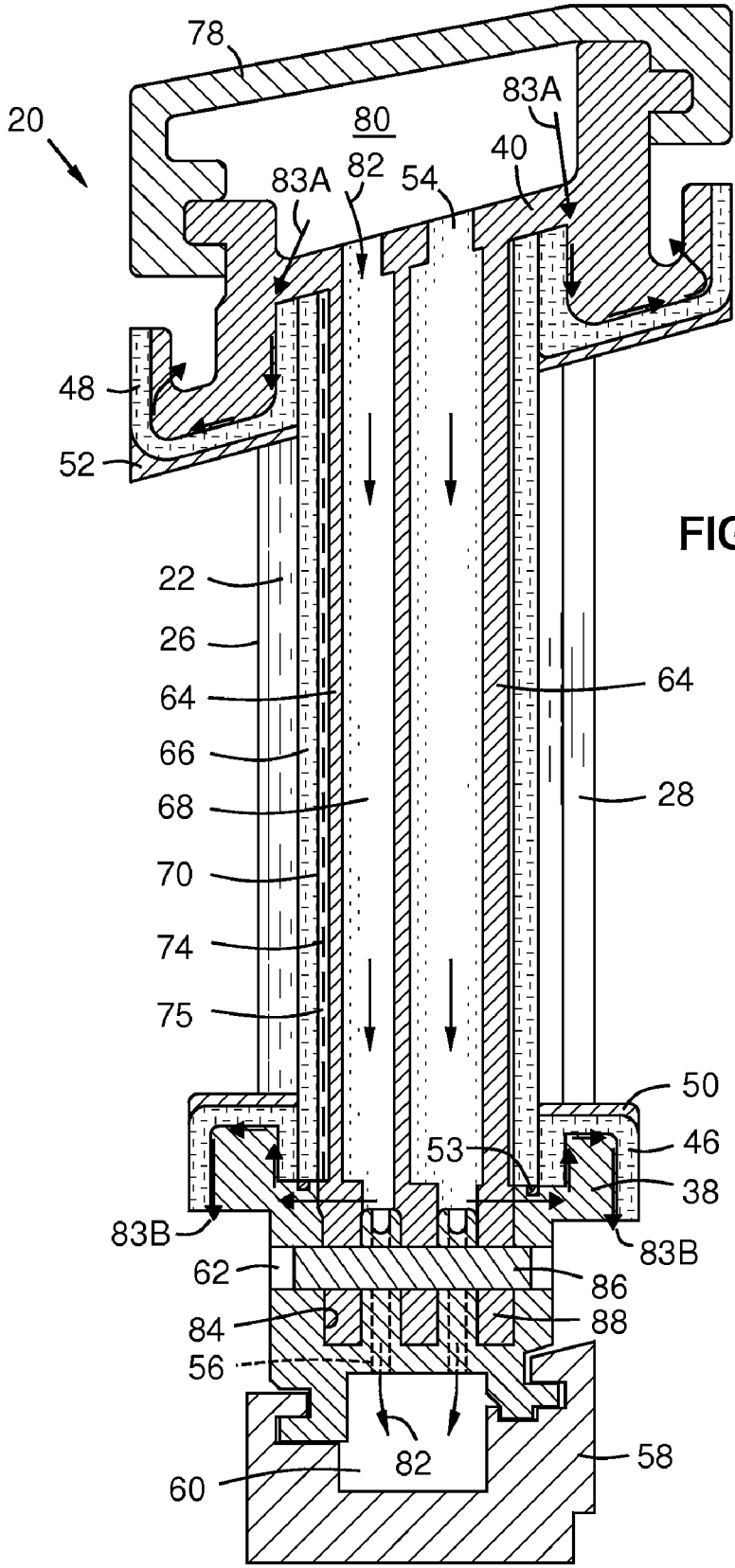
FIG. 4 is a sectional view of a vane assembly taken along line 4-4 of FIG. 2.

FIG. 4 shows a sectional view of a vane assembly 20 taken on a section plane as indicated in FIG. 2. A vane carrier ring 78 supports the outer backing plates 40, and may enclose a cooling fluid supply plenum 80. The cooling fluid 82 enters ports 54 in the outer backing plate, and travels down one or more medial cooling channels 68 in the vane strut 64. The cooling fluid 82 is metered through small ports around the outside of the airfoil 66 adjacent to the outer backing plate 40.

A portion 83A of the cooling fluid may flow through a network of outer shroud coolant passages as shown by routing arrows in FIG. 4. These passages are created in the metal backing plate 40. Cooled areas are the shroud areas that expose CMC to the turbine hot gas fluid. The cooling circuit becomes functional when the CMC shroud 48 and metal backing plate 40 are assembled and fastened together. Similarly, a portion 83B of the cooling fluid may be metered through small ports around the inner cavities 84 above the junction of these cavities with inner end 88 of the strut. This cooling fluid is allowed to flow through a network of inner shroud coolant passages. These passages are created in the metal backing plate 38. Cooled areas are the shroud areas that expose CMC to the turbine hot gas fluid. The cooling circuit becomes functional when the CMC shroud 46 and metal backing plate 38 are assembled and fastened together.

The inner end 88 of the vane strut 64 may be inserted into a fitted socket 84 formed of one or more cavities in the inner backing plate 38, and affixed therein with a pin 86 or other mechanical fastener. The pin 86 may be held by ring clips 87 or other means known in the art, and may be releasable, so that the inner platform can be removed for easy replacement of the CMC vane airfoil 66. Flexible seals 53 of a material known in the art may be provided in the backing plates 38, 40, sealing against the respective shroud covers 46, 48 and/or the ends of the strut 64 and/or the CMC vane airfoil 66 as shown to limit coolant leakage. The inner end of the medial cooling channel 68 may exit into the inner plenum 60, via the exit holes 56 in the inner backing plate 38. This exit may be metered to direct coolant into the tributary channels 69.

Figure 5:
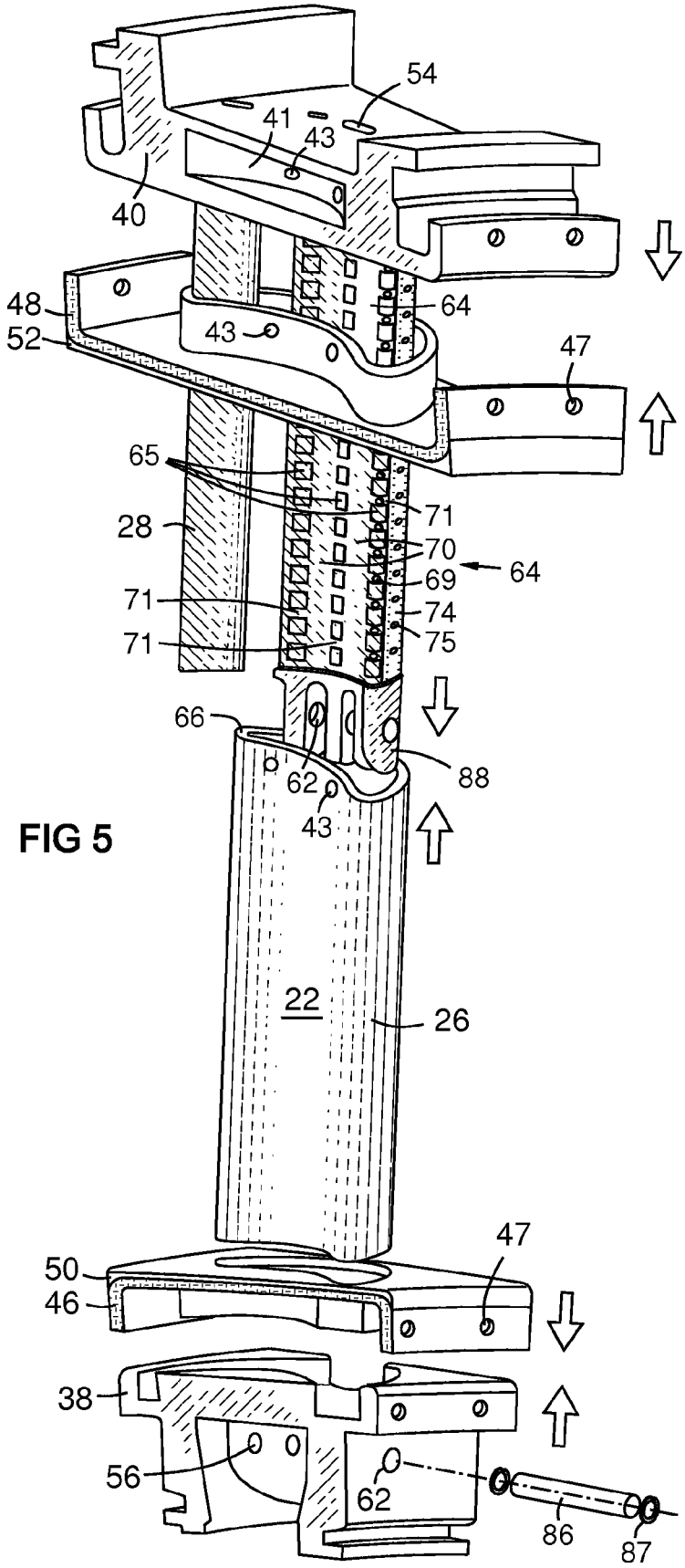
FIG. 5 is an exploded perspective view of a vane assembly.
Figure 6:
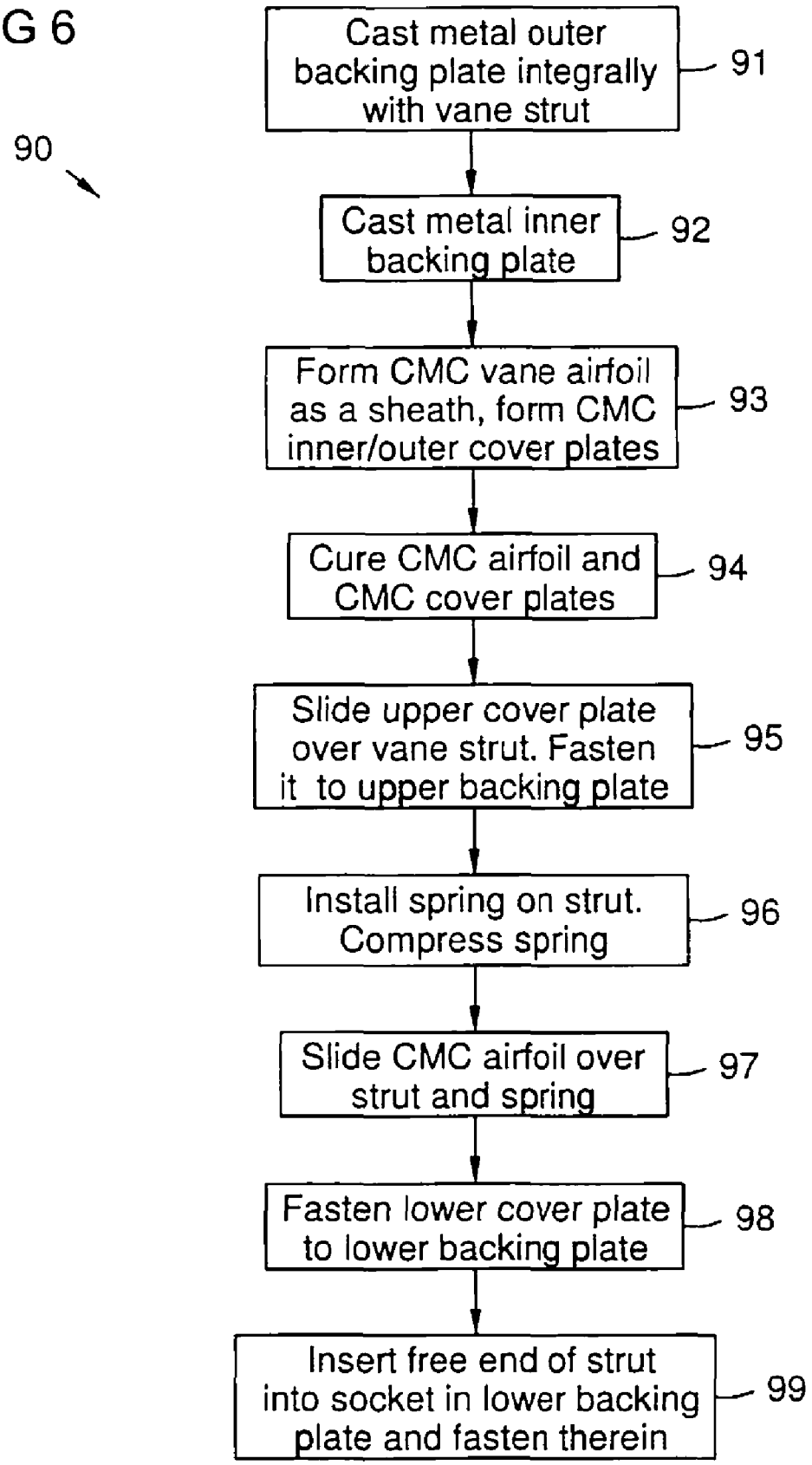
FIG. 6 illustrates a method of assembling the vane assembly.

FIG. 5 shows an exploded view of an exemplary embodiment of the vane assembly. FIG. 6 illustrates an exemplary method of assembly 90 as follows:

91—The outer backing plate 40 is cast integrally with the vane strut 64 and trailing edge 28.

92—The inner backing plate 38 is cast separately.

93—The CMC vane airfoil 22 and the CMC shroud covers 46, 48 are formed, and are coated if desired.

94—The CMC parts 22, 46, 48 are cured.

95—The outer shroud cover 48 is slid over the strut 64 and fastened to the outer backing plate 40.

96—The spring 74 is installed on the strut 64 and compressed temporarily with a clamp, sleeve, or other means such as a fugitive matrix that holds the spring in compression. The spring is released within the CMC airfoil.

97—The CMC airfoil 66 is slid over the strut 64 and the spring 74, and may be fastened to the outer shroud cover 48.

98—The inner shroud cover 46 is fastened over the inner backing plate 38.

99—The free end 88 of the strut is inserted into the socket 84 in the inner backing plate, and is fastened with a pin 86 or other means.

The assembly is now ready for insertion into the vane carrier 78 (FIG. 4). The trailing edge 28 may be cast integrally with the outer backing plate as shown, or optionally may be formed separately and inserted into sockets in the outer and inner backing plates. These sockets will be fitted with seals to limit the loss of cooling fluid.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A vane assembly for a gas turbine, comprising:

first and second metal backing plates;

a metal vane strut spanning between the backing plates, a first end of the vane strut formed integrally with the first backing plate;

a cooling channel extending medially through the vane strut;

a ceramic matrix composite (CMC) or superalloy airfoil mounted as a sheath over the vane strut and defining a spring chamber there between extending peripherally along a length of the vane strut;

a spring installed in the spring chamber, wherein the spring is compressed between an inner surface of the CMC or superalloy airfoil and an outer surface of the vane strut;

the second backing plate releasably attached to a second end of the vane strut; and first and second CMC shroud covers that cover facing surfaces of the respective first and second backing plates to protect the backing plates from a working gas flow;

wherein a first portion of a cooling gas flows through a network of outer shroud coolant passages in the first backing plate between the first backing plate and the first shroud cover, and a second portion of the cooling gas flows through a network of inner shroud coolant passages in the second backing plate between the second backing plate and the second shroud cover.

2. The vane assembly of claim 1, wherein the first backing plate is a radially outer or distal backing plate in the gas turbine relative to the second backing plate.

3. The vane assembly of claim 2 further comprising a metal airfoil trailing edge spanning between the backing plates, wherein a cooling channel passes medially through a length of the trailing edge.

4. The vane assembly of claim 3, wherein a first end of the trailing edge is formed integrally with the first backing plate.

5. A circular array of vane assemblies each according to claim 2, wherein the respective first backing plates of the vane assemblies are attached to an outer vane carrier ring, the respective second backing plates of the vane assemblies are attached to an inner U-ring, and the vane assemblies rigidly support the inner U-ring from the outer vane carrier ring in a concentric relationship within the gas turbine; wherein the outer vane carrier ring forms a cooling gas distribution plenum, the inner U-ring forms a cooling gas inner plenum, and a cooling gas flows from the distribution plenum through the cooling channels in the struts to the inner plenum.

6. The vane assembly of claim 1, wherein the spring wraps around part of a suction side of the airfoil strut, and further comprising a plurality of peripheral contact areas on the strut defining a peripheral surface geometry that matches the inner surface of the CMC or superalloy airfoil on at least a pressure side of the strut.

7. The vane assembly of claim 6, wherein the strut further comprises peripheral cooling paths defined between the strut and the inner surface of the CMC or superalloy airfoil and between the peripheral contact areas, wherein the peripheral cooling paths comprise both radial coolant paths extending along the radial length of the strut and transverse coolant paths extending around the outer surface of the strut from a leading edge to a trailing edge thereof, wherein a plurality of coolant tributary holes pass between the medial cooling channel in the strut and the peripheral cooling paths at the leading edge of the strut, and further comprising a coolant drain between the strut and the CMC or superalloy airfoil at the trailing edge of the strut, the coolant drain being in fluid communication with the peripheral cooling paths and with an inner cooling plenum.

8. The vane assembly of claim 7, wherein the spring is formed as a plate with corrugations, wherein a plurality of holes pass through the spring between peaks and valleys of the corrugations, and wherein the spring chamber and the holes in the spring provide peripheral coolant paths along the suction side of the strut.

9. The vane assembly of claim 1 wherein the second end of the vane strut is inserted into a socket with a seal apparatus in the second backing plate and is locked therein with a pin.

10. The vane assembly of claim 9, wherein the pin is locked in the second backing plate with removable ring clips.

11. A method for forming a gas turbine vane assembly, comprising forming a metal vane strut integrally with an outer metal backing plate, wherein the vane strut comprises medial and peripheral cooling paths and a peripheral spring chamber;

forming a metal inner backing plate;

forming and curing a ceramic matrix composite (CMC) vane airfoil comprising an inner surface that generally matches an outer geometry of the vane strut;

forming and curing CMC outer and inner shroud covers;

sliding the CMC outer shroud cover over the vane strut, and attaching the CMC outer shroud cover to the outer backing plate;

forming a wave spring with an array of holes;

mounting the wave spring in the spring chamber, wherein the wave spring extends from the outer geometry of the vane strut to interfere with the inner surface of the CMC vane airfoil;

compressing the spring to fit within the inner surface of the CMC vane airfoil;

sliding the CMC vane airfoil as a sheath over the vane strut;

attaching the CMC inner shroud cover to the inner backing plate; and attaching a free end of the vane strut to a socket in the second backing plate.

12. The method of claim 11, further comprising forming a metal trailing edge integrally with the outer metal backing plate, wherein the metal trailing edge comprises a medial cooling channel.

13. A vane assembly for a gas turbine, comprising:

first and second metal backing plates;

a metal vane strut spanning between the backing plates, a first end of the vane strut formed integrally with the first backing plate;

a cooling channel extending medially through the vane strut;

a ceramic matrix composite (CMC) or superalloy airfoil mounted as a sheath over the vane strut and defining a spring chamber there between extending peripherally along a length of the vane strut;

a spring installed in the spring chamber, wherein the spring is compressed between an inner surface of the CMC or superalloy airfoil and an outer surface of the vane strut, wherein the spring wraps around part of a suction side of the airfoil strut;

the second backing plate releasably attached to a second end of the vane strut;

a plurality of peripheral contact areas on the strut defining a peripheral surface geometry that matches the inner surface of the CMC or superalloy airfoil on at least a pressure side of the strut; and peripheral cooling paths defined between the strut and the inner surface of the CMC or superalloy airfoil and between the peripheral contact areas, wherein the peripheral cooling paths comprise both radial coolant paths extending along the radial length of the strut and transverse coolant paths extending around the outer surface of the strut from a leading edge to a trailing edge thereof, wherein a plurality of coolant tributary holes pass between the medial cooling channel in the strut and the peripheral cooling paths at the leading edge of the strut, and further comprising a coolant drain between the strut and the CMC or superalloy airfoil at the trailing edge of the strut, the coolant drain being in fluid communication with the peripheral cooling paths and with an inner cooling plenum;

wherein the spring is formed as a plate with corrugations, wherein a plurality of holes pass through the spring between peaks and valleys of the corrugations, and wherein the spring chamber and the holes in the spring provide peripheral coolant paths along the suction side of the strut.

14. The vane assembly of claim 13, wherein the second end of the vane strut is inserted into a socket with a seal apparatus in the second backing plate and is locked therein with a pin.

15. A circular array of vane assemblies each according to claim 13, wherein the respective first backing plates of the vane assemblies are attached to an outer vane carrier ring, the respective second backing plates of the vane assemblies are attached to an inner U-ring, and the vane assemblies rigidly support the inner U-ring from the outer vane carrier ring in a concentric relationship within the gas turbine;

wherein the outer vane carrier ring forms a cooling gas distribution plenum, the inner U-ring forms a cooling gas inner plenum, and a cooling gas flows from the distribution plenum through the medial cooling channels in the struts to the inner plenum.

* * * * *